United States Patent [19]

Bullard

[11] Patent Number: 4,838,594

[45] Date of Patent: Jun. 13, 1989

[54] RUNNING AND PULLING TOOL

[75] Inventor: Roy P. Bullard, Grand Prairie, Tex.

[73] Assignee: Otis Engineering Corporation, Dallas, Tex.

[21] Appl. No.: 111,184

[22] Filed: Oct. 22, 1987

Related U.S. Application Data

[63] Continuation-in-part of Ser. No. 916,024, Oct. 6, 1986, Pat. No. 4,767,145.

[51] Int. Cl.[4] ..... E21B 23/00

[52] U.S. Cl. ..... 294/86.18; 166/125; 166/217; 294/86.19; 294/86.25

[58] Field of Search ..... 294/86.14, 86.15, 86.17, 294/86.23, 94, 96; 166/98, 99, 125, 137, 215, 217

[56] References Cited

U.S. PATENT DOCUMENTS

| | | | |
|---|---|---|---|
| 1,580,352 | 4/1926 | Ventresca | 294/86.15 |
| 3,051,239 | 8/1962 | Dollison | 166/125 |
| 3,863,715 | 2/1975 | Yonker | 166/125 X |
| 4,295,528 | 10/1981 | Carmody | 166/217 X |
| 4,368,911 | 1/1983 | Pringle | 294/86.25 X |
| 4,558,895 | 12/1985 | Tamplen | 294/86.18 |

OTHER PUBLICATIONS

Otis Wireline Equipment Brochure, OEC 5121 C, p. 115, "Otis Wireline Pulling Tools".

*Primary Examiner*—Johnny D. Cherry
*Attorney, Agent, or Firm*—Roland O. Cox

[57] ABSTRACT

Two embodiments of an improved tool, which may be used as a running tool or a pulling tool for well tools. The improved structures provide running pulling tools which may be jarred upwardly on or jarred downwardly on as long as required after engaging a tool set in well pipe and may be released from the well tool when desired. When the running pulling tools are jarred downwardly, they will operate to release if either the tool mandrels or tool skirts contact with well tool. Each tool skirt is positioned in contact with external dog shoulders, providing increased impact area and eliminating costly precision machining of tool parts. Both improved tools may be manually released from a well tool on surface. One embodiment may be prepared for further use with the aid of hand tools. The other embodiment may be prepared for further use almost by hand.

13 Claims, 9 Drawing Sheets

RUNNING AND PULLING TOOL

This is a continuation-in-part application of my copending application for U.S. Pat. Ser. No. 916,024 filed Oct. 6, 1986 now U.S. Pat. No. 4,767,145.

BACKGROUND

This invention pertains to tools useful in servicing earth wells and particularly running and pulling tools usually used in wireline tool strings to run, operate in and pull tools from a well.

Many forms of running tools, pulling tools, and combination running and pulling tools have been developed to engage external and internal fishing necks on well tools to be run into or pulled from wells on pipe or wireline. Weight or pull is applied to running and pulling tools or they are "jarred", either upwardly or downwardly, to engage tool fishing necks on tools installed in wells, to lock, unlock or operate well tools while engaged and to release from a fishing neck after locking the tool or if the tool cannot be jarred to unlock and be retrieved from the well.

One form of a pulling tool is shown in U.S. Pat. No. 3,051,239 to Dollison. This tool engages an internal fishing neck and can only be released from the fishing neck by jarring downwardly and cannot be released if the tool mandrel or attached prong contacts inside an engaged fishing neck before the outside of the tool contacts the top end of a fishing neck. Also this tool was found to be expensive to manufacture because of close parts tolerances required to strengthen the tool to resist repeated jar impacting and is difficult to release from tool fishing necks manually on the surface.

As well servicing art and tools developed, requirements arose for this type running pulling tool to be jarred upwardly to cause release from a well tool fishing neck. As shown on page 115 of OTIS WIRELINE SUBSURFACE FLOW CONTROLS AND RELATED SERVICE EQUIPMENT, OEC 5121C, a publication of Otis Engineering Corporation, Dallas, Tex., a "GU" shear up adapter was made available to convert the modified "GS" running and pulling tool covered by the Dollison patent into a jar upwardly to release tool. This tool must be assembled with the adapter on the surface as a jar upwardly to release tool or without adapter for a jar downwardly to release tool, before running into the well.

An example of a pulling tool which engages an external fishing neck is covered by U.S. Pat. No. 4,558,895 to Tamplen. This tool must also be assembled on the surface for either upward jar release or downward jar release.

The improved running pulling tool invention provides two embodiments of a tool which may be repeatedly jarred downwardly or upwardly as required after engaging an internal fishing neck and later be released from the fishing neck at any desired time by downward jarring. These tools will release when jarred downwardly on contact of either the lower end of the mandrel with the inside of the engaged fishing neck or by contact of the lower end of the tool outside with the top of the fishing neck. The impact absorbing parts may be positioned to eliminate clearances between assembled parts, which gives the tools extended impact life, permits looser part tolerances and reduces manufacturing costs. After the invention tools have retrieved well tools back to surface, the improved running pulling tools may be easily released from the well tool fishing necks.

Another preferred embodiment of the improved running pulling tool of this invention provides a "user friendly" structure, which may be easily prepared for further use to run or pull well tools. This embodiment includes means for removing all compression from the tool main spring allowing parts of the improved tool to be moved freely by hand to reposition for further use.

One object of this invention is to provide one tool which may be used to run or pull well tools from a well.

Another object of this invention is to provide a running pulling tool which, after engaging a well tool fishing neck, may be either jarred upwardly or jarred downwardly as long as required.

Another object of this invention is to provide a running pulling tool which may be released from a fishing neck at any time after engagement therewith.

Another object of this invention is to provide a running pulling tool which does not have to be retrieved to surface to reverse jarring direction for release.

Another object of this invention is to provide a running pulling tool which, when jarred down, will operate if the tool contacts the well tool fishing neck or if the tool mandrel contacts the well tool.

Also an object of this invention is to provide a less expensive running pulling tool not requiring precisely manufactured parts.

Another object of this invention is to provide a running pulling tool having improved impact resistance when jarred upwardly.

Another object of this invention is to provide an improved running pulling tool which may be easily released from a retrieved well tool.

Also an object of this invention is to provide an improved running and pulling tool which is easy to release from a retrieved tool and prepare for further use.

DESCRIPTION OF THE PREFERRED EMBODIMENTS

Figure 1A:
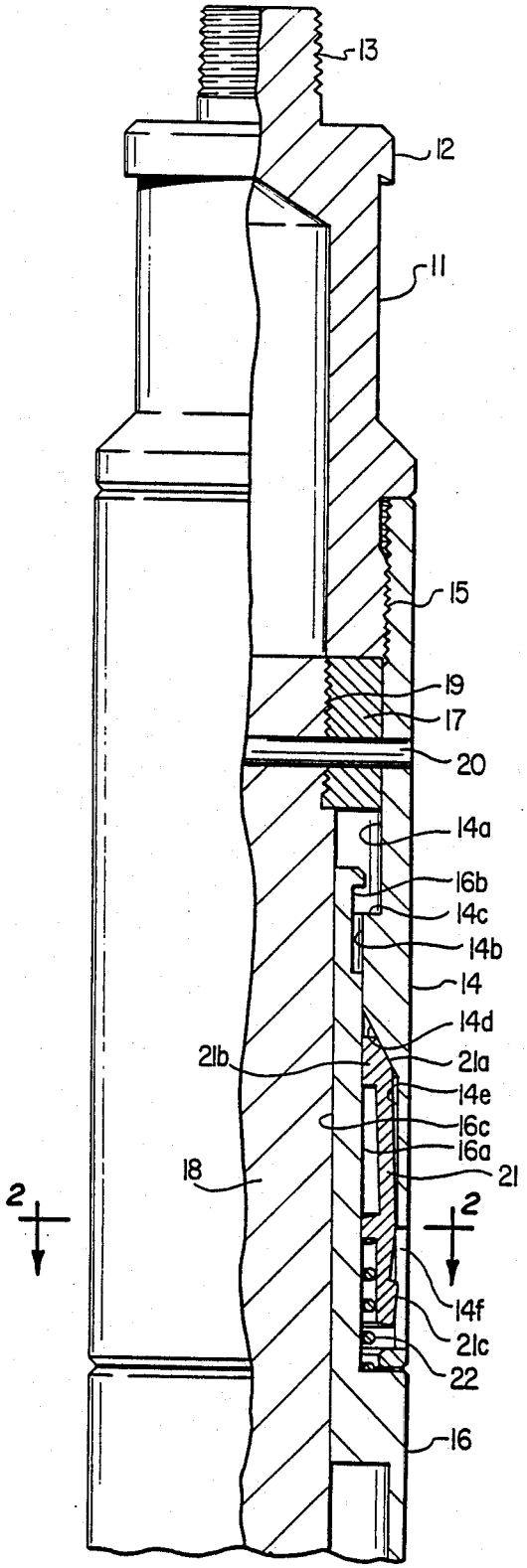
FIGS. 1A and 1B are a sectioned drawing in elevation of the running pulling tool of this invention, shown engaging a fishing neck.
Figure 1B:
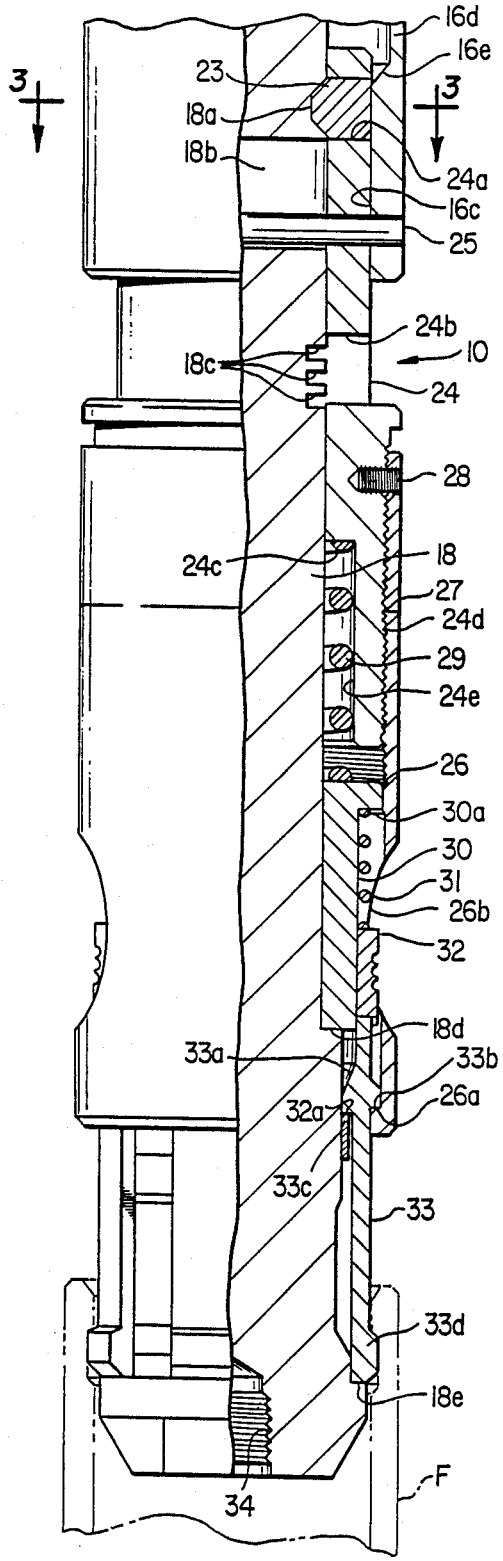

FIGS. 1A and 1B show the running pulling tool 10 of this invention, which has a fishing neck 11 with an external flange 12 and an appropriate thread 13 for connecting the tool to a wireline tool string or pipe. The fishing neck is connected to upper connecting housing 14 with threads 15. The upper housing has bores **14*a* and 14*b*, a shoulder 14*c*, a camming surface 14*d*, and another bore 14*e* with openings 14*f* therein. Slidably mounted in housing bore 14*b* is a reduced diameter portion 16*a* of intermediate locking housing 16. This housing has a groove 16*b*, a bore 16*c*, an overbore 16*d* and a camming surface 16*e***.

Slidably mounted in upper housing bore **14*a* is a nut 17 connected to tool mandrel 18 by thread 19. A shear pin 20 passes through the upper housing wall, the nut, the mandrel and on through the nut and other housing wall and retains nut 17 on mandrel 18**.

Figure 2:
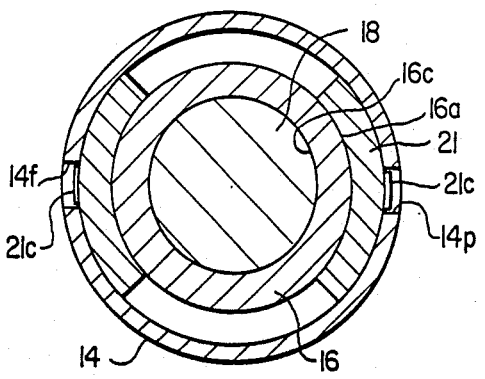
FIG. 2 is the drawing of a cross section along line 2—2 in FIG. 1.
Figure 7:
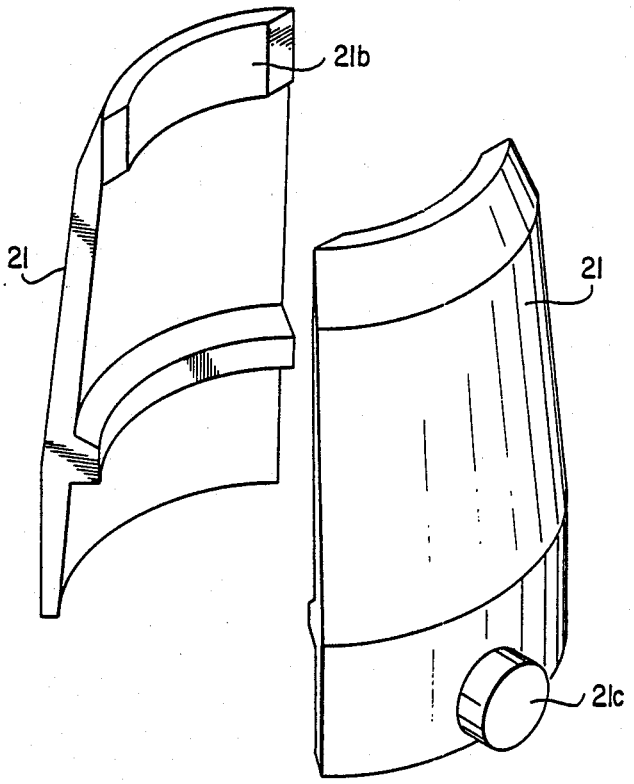
FIG. 7 is an isometric view of latches utilized in the present invention.

Mounted in bore **14*e* in housing 14 around portion 16*a* are latches 21, also shown in FIGS. 2 and 7. Each latch has a camming surface 21*a* engaging surface 14*d* and end projections 21*b* and 21*c*. A compressed spring 22 maintains engagement of surfaces 21*a* and 14*d***.

Figure 3:
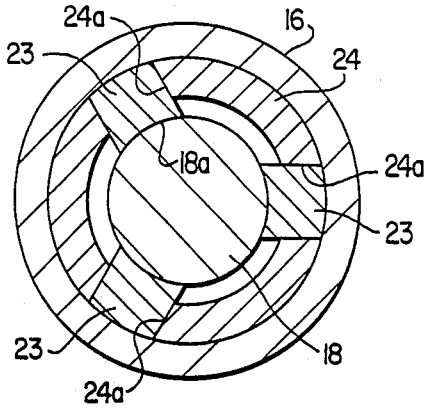
FIG. 3 is the drawing of a cross section along line 3—3 in FIG. 1.

FIG. 1 and FIG. 3 show cammable lugs 23 mounted for lateral movement in openings **24*a* in lower engaging and releasing housing 24 and held engaged in mandrel recess 18*a* by bore 16*c* in the upper housing. Intermediate housing 16 is connected to lower housing 24 by shear pin 25. This shear pin may move longitudinally in lateral opening 18*b* in mandrel 18. The lower housing is slidably mounted on the mandrel and has an opening 24*b*, a shoulder 24*c*, a thread 24*d* and a bore 24*e*. Mandrel 18 has a number of grooves 18*c* adjacent opening 24*b*. Threadedly connected to the housing by thread 24*d* is a skirt 26 and a jam ring 27. The skirt has an internal shoulder 26*a* and openings 26*b*. A lock screw 28 is threaded through the jam ring into the lower housing to lock the jam ring in position. Disposed in bore 24*e* and around the mandrel is a compressed spring 29 between shoulder 24*c* and the top of a spacer ring 30. The spacer has a shoulder 30*a* and is biased into contact with upper mandrel shoulder 18*d* by spring 29. Around spacer 30 is a compressed spring 31 between shoulder 30*a* and retainer ring 32 which biases the retainer and dogs 33 downwardly to engage lower mandrel shoulder 18*e*. Each dog 33 has a camming surface 33*a* an external shoulder 33*b*, an internal shoulder 33*c* and a lug portion 33*d*. Shoulders 33*c* protrude into openings 32*a* in the retainer. A thread 34 is provided at the lower end of mandrel 18 for attachment of appropriate operating prongs to tool 10. Dogs 33 are shown engaging an internal fishing neck F in FIG. 1B**.

After assembly of running pulling tool 10 and before screw 28 is installed, ring 27 is turned to permit skirt 26 to be turned and adjusted so that shoulder **26*a* contacts dog shoulders 33*b*. This contact area, in addition to the area of contact between the lower end of dogs 33 and shoulder 18*e***, is available to share impact force loading on the tool when jarring up. Heretofore the additional area was not available on running pulling tools, even with expensive very close tolerance machining of many tool parts because of cumulative tolerance buildup between a number of parts in an assembly.

After proper adjustment of skirt 26, jam ring 27 should be tightened against the skirt to retain the skirt in proper position, and lock screw 28 should be installed through the ring to lock the ring in skirt jamming position.

Figure 6A:
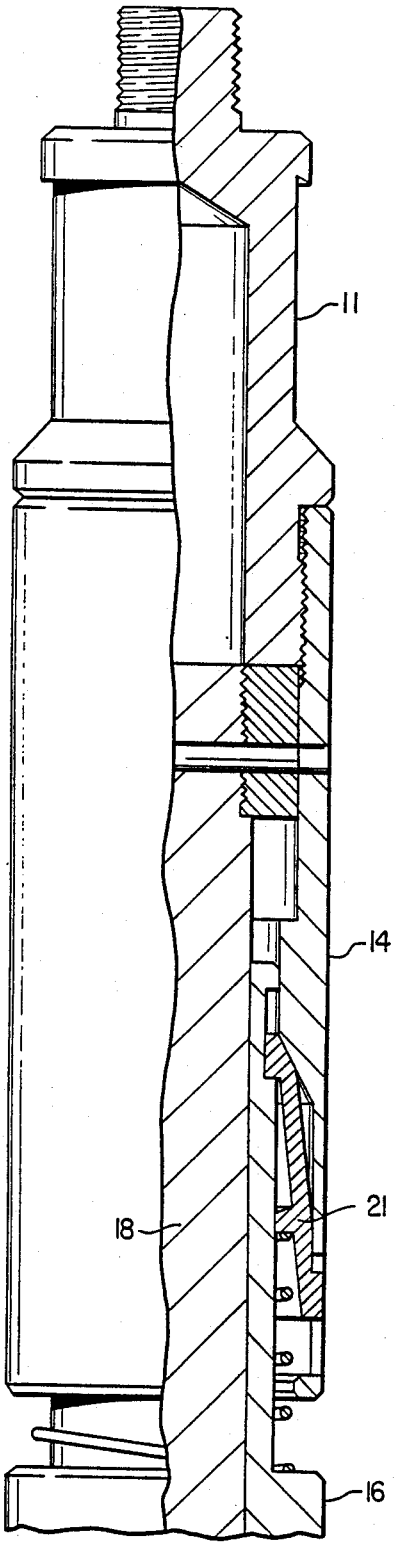
FIGS. 6A and 6B show the invention tool released from the fishing neck.
Figure 6B:
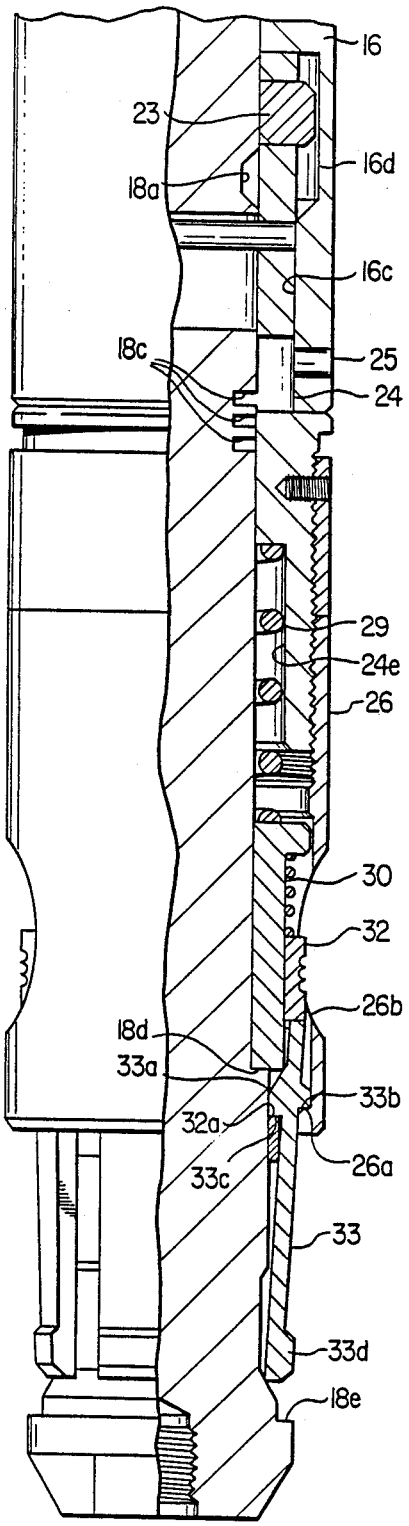

The tool 10 of the present invention is used as a running tool by attaching to a tool string and engaging dogs 33 in an internal well tool fishing neck F, as shown in FIG. 1, on the surface. Tool 10 carrying a well tool is then lowered into a well pipe and jarred or weight or pull applied to operate the well tool. The running pulling tool is then jarred downwardly or weight is applied to retract the dogs as shown in FIG. 6 and release it from the well tool fishing neck for retrieval to the surface as described below.

Figure 4A:
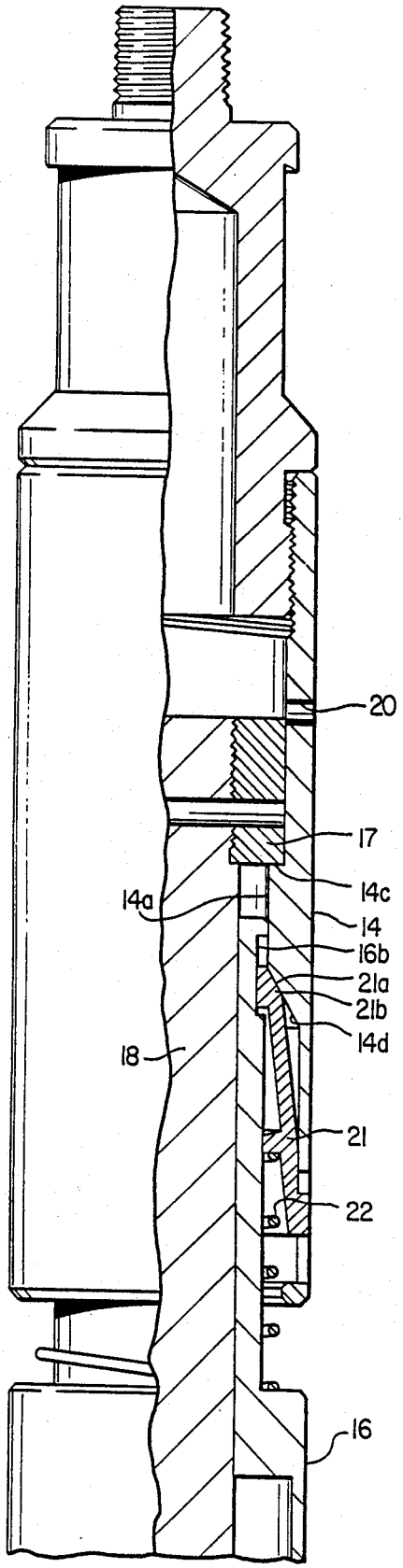
FIGS. 4A and 4B are a sectioned drawing in elevation of the invention tool shown in the first stage of releasing from the fishing neck.
Figure 4B:
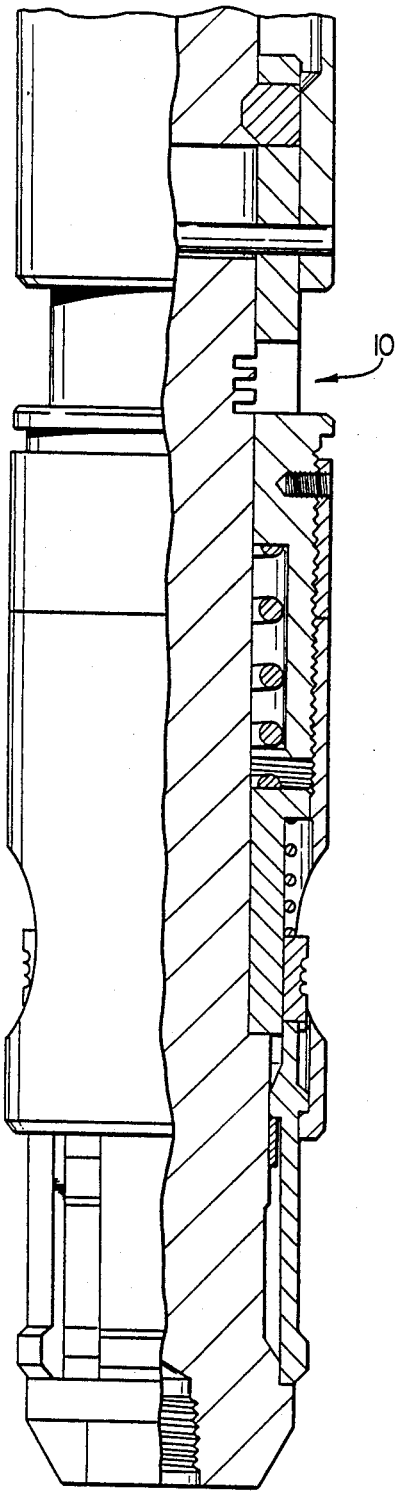

To use the tool 10 of the present invention as a pulling tool, the tool in the form of FIGS. 1A and 1B is connected in a tool string and lowered into well pipe to latch into and engage the internal fishing neck on top of a well tool set in the well pipe. The running pulling tool 10 is then jarred downwardly to release the well tool for pulling from the well. While jarring down, either tool mandrel 18 or the lower end of skirt 26 may impact the well tool or well tool fishing neck. Impact of the invention tool on the well tool is not limited to skirt bottom to fishing neck top only, and the running pulling tool may be operated to release if impact is delivered to the well tool fishing neck through the skirt or mandrel of invention tool 10. If the well tool cannot be released by prolonged jarring downwardly, the tool 10 may be jarred upwardly, which shears pin 20, permitting shoulder **14*c* in the upper housing to be moved up to contact the lower end of nut 17. As shown in FIG. 4, spring 22 has moved latches 21 upwardly, and camming surfaces 21*a* moving along camming surface 14*d* have moved the latch end projections 21*b* into groove 16*b* connecting upper housing 14 to intermediate housing 16**.

If prolonged upward jarring does not release the well tool, then running pulling tool 10 may again be jarred downwardly to release from the well tool fishing neck.

Figure 5A:
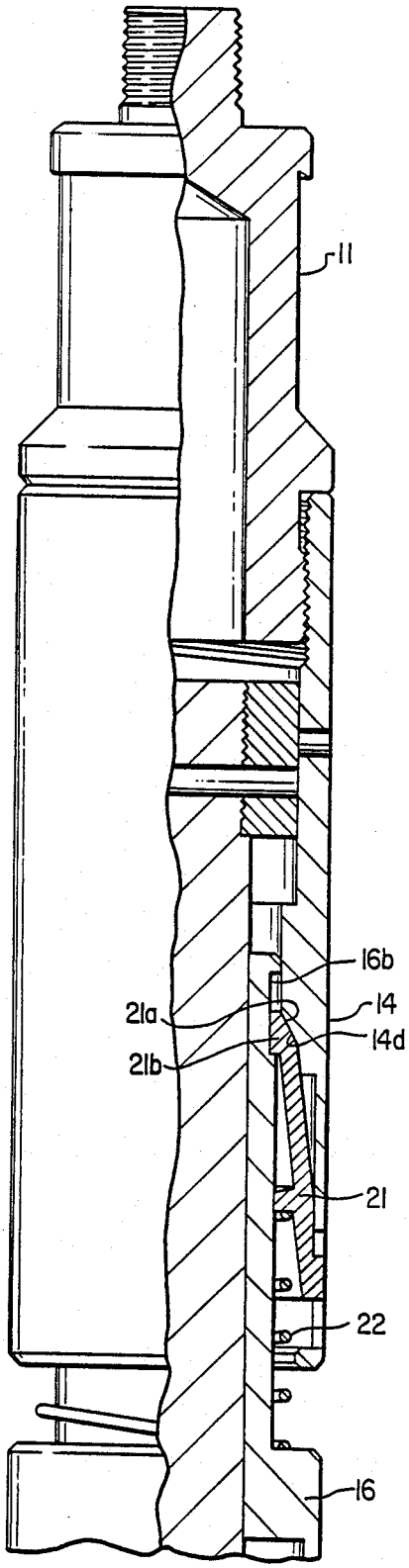
FIGS. 5A and 5B show the invention tool in the second stage of releasing.
Figure 5B:
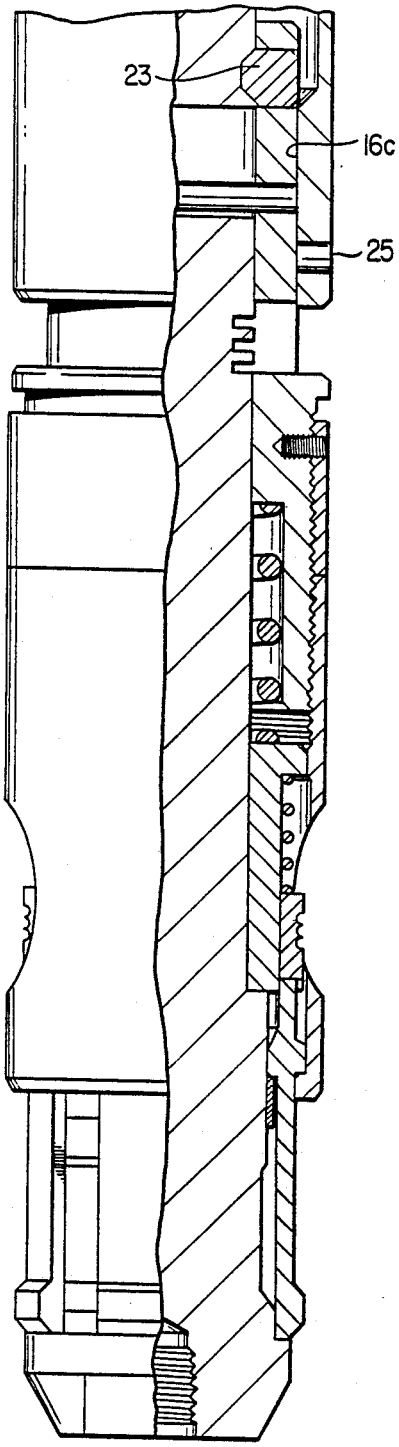

As the upper and intermediate housings are now connected by latches 21, downward jarring will move fishing neck 11, upper body 14 and intermediate body 16 downwardly, shearing pin 25 and moving bore **16*c* below lug 23 as shown in FIG. 5. Now, as shown in FIG. 6, compressed spring 29 moves lower housing 24 upward on the mandrel, camming lugs 23 out of mandrel groove 18*a* and into housing overbore 16*d*, disconnecting housing 24 from mandrel 18. Spring 29 moves lower housing 24 further upward, lifting skirt 26 and dogs 33 through shoulders 26*a* and 33*b* from shoulder 18*e*. Just before upward travel of the lower housing and dogs is stopped by contact with the lower end of intermediate housing 16, dog camming surface 33*a* contacts the outside lower end corner of spacer 30, and dogs 33 are cammed inwardly to contact a smaller diameter on mandrel 18, disengaging fishing neck F and releasing tool 10** from the well tool fishing neck for retrieval from the well.

At the surface, retainer 32 may be gripped through skirt openings **26*b* and moved upwardly on spacer 30, compressing spring 31, lifting dogs 33 from shoulder 18*e* and camming the dogs to retract inwardly as shown in FIG. 6, releasing tool 10** from the well tool fishing neck.

To prepare running pulling tool 10 for further use, upper housing 14 may be moved upwardly on housing 16 and latch projections **21*c* pushed in to disconnect the upper housing from the intermediate housing. Housing 14 may now be pushed down on housing 16, returning housing 14 to the position shown in FIG. 1. A screwdriver or other lever, inserted through opening 24b and into a slot 18c, may be used to pry the lower housing and dogs back into fishing neck engaging position as shown in FIG. 1. On replacement of sheared pins 20 and 25, the running pulling tool 10** of this invention will be ready for further use.

Figure 8A:
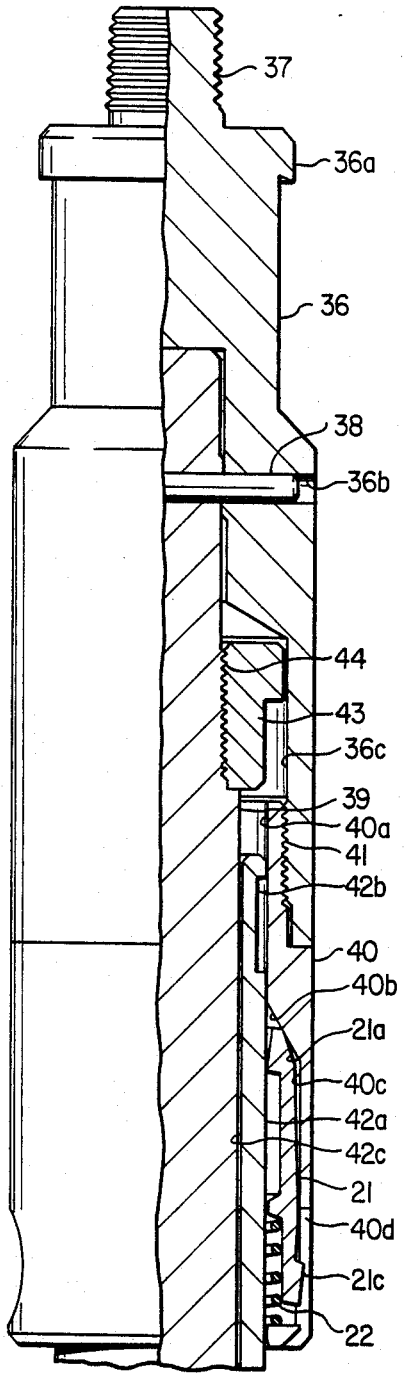
FIGS. 8A and 8B are a sectioned drawing in elevation of another embodiment of the running pulling tool of this invention.
Figure 8B:
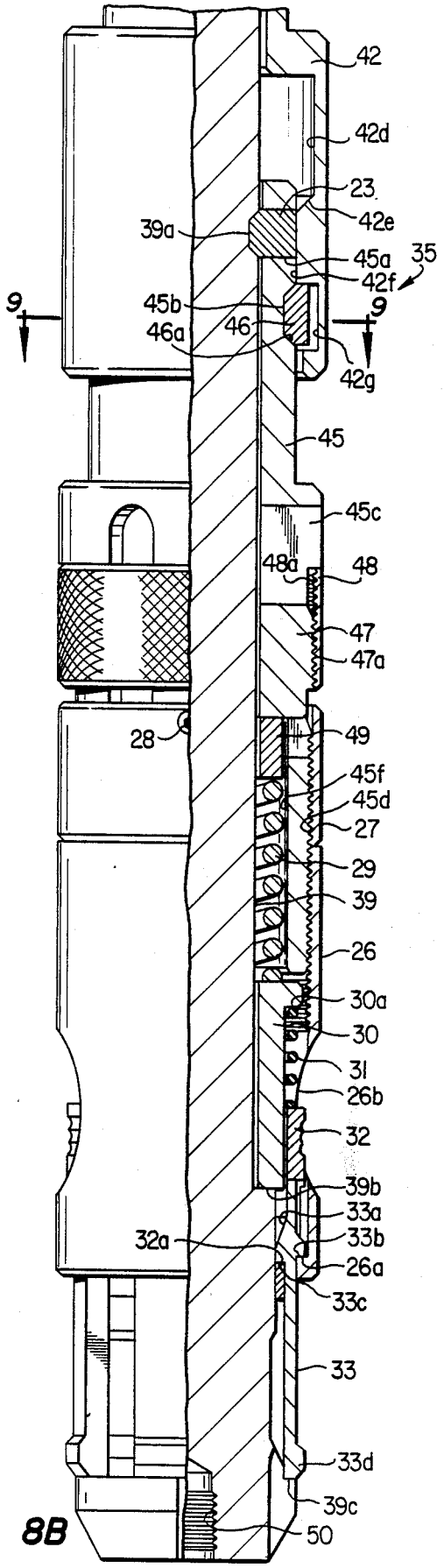

FIGS. 8A and 8B show another embodiment 35 of the running pulling tool of this invention, which has a fishing neck 36 with an external flange 36a and an appropriate thread 37 for connecting the tool to a wireline tool string or pipe. The fishing neck has a hole 36b through which a shear pin 38 is passed into a hole in tool mandrel 39 releasably connecting the mandrel and fishing neck. The fishing neck also has a bore 36c and is connected to upper connecting housing 40 with threads 41. The upper housing has a bore 40a, a camming surface 40b, and another bore 40c with openings 40d. Slidably mounted in housing bore 40a is a reduced diameter portion 42a of intermediate locking housing 42. This housing has a groove 42b, a bore 42c, an overbore 42d and a camming surface 42e. Slidably mounted in fish neck bore 36c is a nut 43 which is connected to mandrel 39 by threads 44.

Mounted in bore 40c around lock housing reduced diameter portion 42a are latches 21. Each latch has a camming surface 21a engaging surface 40b and as shown in FIG. 7, end projections 21b and 21c. End projections 21c extend into openings 40d. A compressed spring 22 maintains engagement of surfaces 21a and 40b.

An engaging and releasing housing 45 with openings 45a, is slidably mounted around tool mandrel 39. Cammable lugs 23, releasably connecting housing 45 and mandrel 39, are mounted for lateral movement in openings 45a and are held engaged in mandrel recess 39a by bore 42f in locking housing 42.

Figure 9:
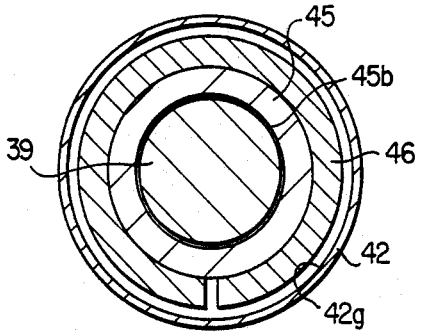
FIG. 9 is a drawing of a cross-section of the running pulling tool of this invention along line 9—9 of FIG. 8.

Housed in overbore 42g is a C ring 46, shown in FIGS. 8 and 9. This C ring has a camming surface 46a and is contracted into groove 45b on housing 45, positioning housing 42 relative to housing 45.

Housing 45 is slidably mounted around mandrel 39 and has a number of through slots 45c and a thread 45d. Slidably mounted in each slot is a lug 47 having a thread 47a. A release ring 48 having a thread 48a is threadedly connected on each lug. Slidably mounted around mandrel 39 below lugs 47 is a bearing ring 49 and a spring 29. This spring is compressed between ring 49 and a spacer ring 30 which engages an upper shoulder 39b on mandrel 39. Also threaded on housing thread 45d is a skirt 26 and a jam ring 27, which has a lock screw 28.

The skirt has an internal shoulder 26a and openings 26b. Around spacer ring 30 is a spring 31, which is compressed between shoulder 30a and a retainer ring 32, which is slidably mounted around ring 30.

A number of internal fishing neck engaging dogs 33 are positioned in openings 32a in retainer ring 32. Compressed spring 31 biases retainer 32 and dogs 33 downwardly to engage lower shoulder 39c on mandrel 39. Each dog 33 has a camming surface 33a, an external shoulder 33b, an internal shoulder 33c and a lug portion 33d. Shoulders 33c protrude into openings 32a in the retainer. A thread 50 is provided in the lower end of mandrel 39 for attachment of appropriate well tool operating prongs to embodiment 35 of the improved running pulling tool of this invention.

Before using running pulling tool 35, for running or pulling a well tool, the skirt 26 should be properly positioned for contact of dog shoulder 33b with skirt shoulder 26a as previously described for running pulling tool 10. Tool 35 may also be used as a running tool as previously described for tool 10.

Figure 10A:
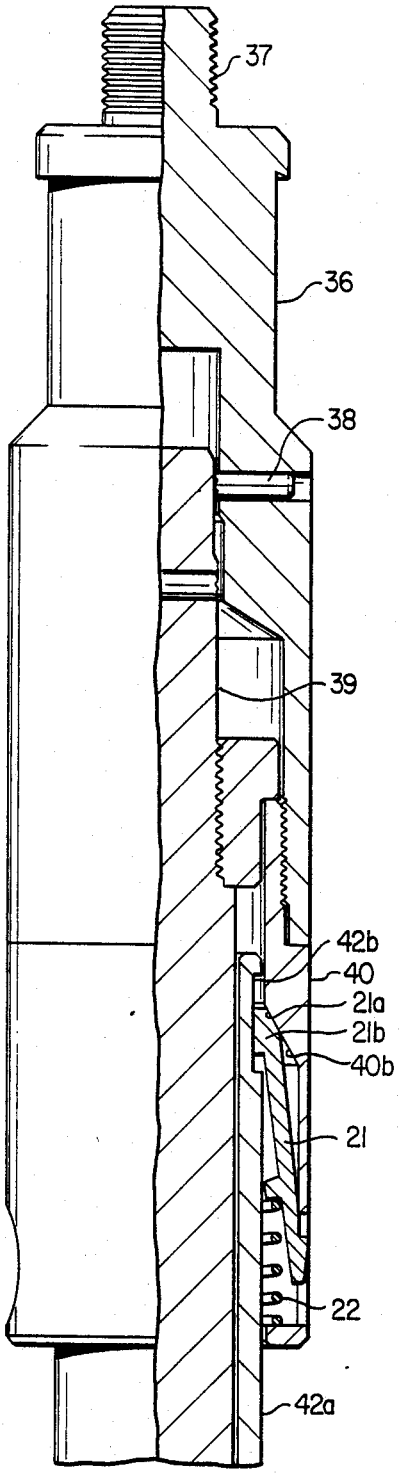
FIGS. 10A and 10B are a sectioned drawing in elevation of the invention tool embodiment of FIGS. 8A and 8B shown in the first stage of releasing from a fishing neck.
Figure 10B:
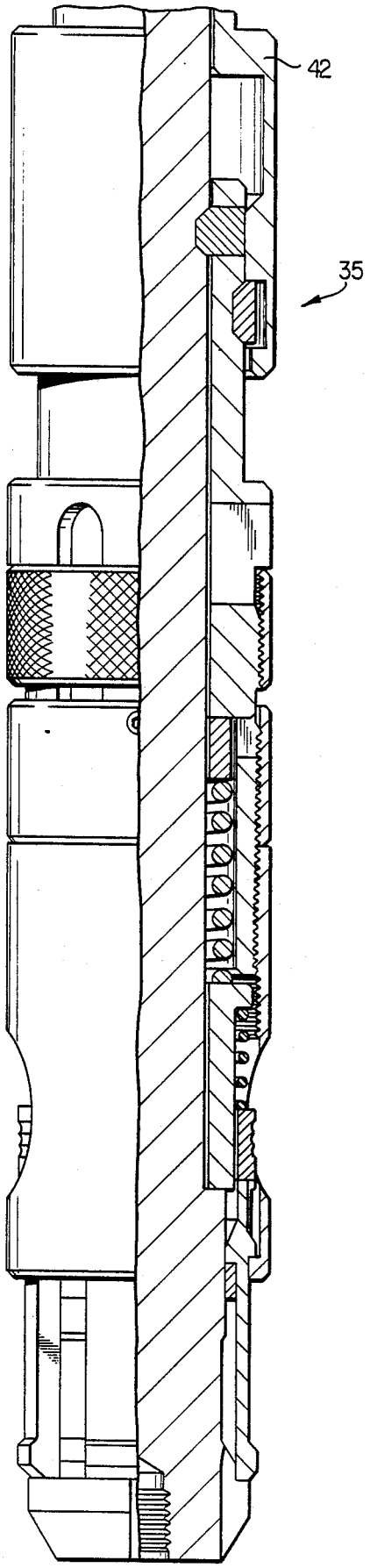

Tool 35, when used as a pulling tool is operated the same as and has the improvements of tool 10. To use tool 35 as a pulling tool, this tool in the form shown in FIGS. 8A and 8B, is connected in a tool string and lowered into well pipe to latch into and engage the internal fishing neck on top of a well tool set in the well pipe. Tool 35 is then jarred downwardly to release the well tool for pulling from the well. While jarring down, either tool mandrel 39 or the lower end of skirt 26 may impact the well tool or well tool fishing neck. Impact on the well tool is not limited to skirt bottom to fishing neck top only, and the running pulling tool may be operated to release if impact is delivered to the well tool fishing neck through the skirt or mandrel. If the well tool cannot be released by prolonged jarring downwardly, tool 35 may be jarred upwardly, which shears pin 38 and moves fish neck 36 and housing 40 upwardly around mandrel 39 and housing portion 42a. As shown in FIG. 10, spring 22 has moved latches 21 upwardly, and camming surfaces 21a moving along camming surface 40b have moved the latch end projections 21b into groove 42b, connecting upper housing 40 to intermediate housing 42.

If prolonged upward jarring does not release the well tool, then running pulling tool 35 may again be jarred downwardly to release from the well tool fishing neck.

Figure 11A:
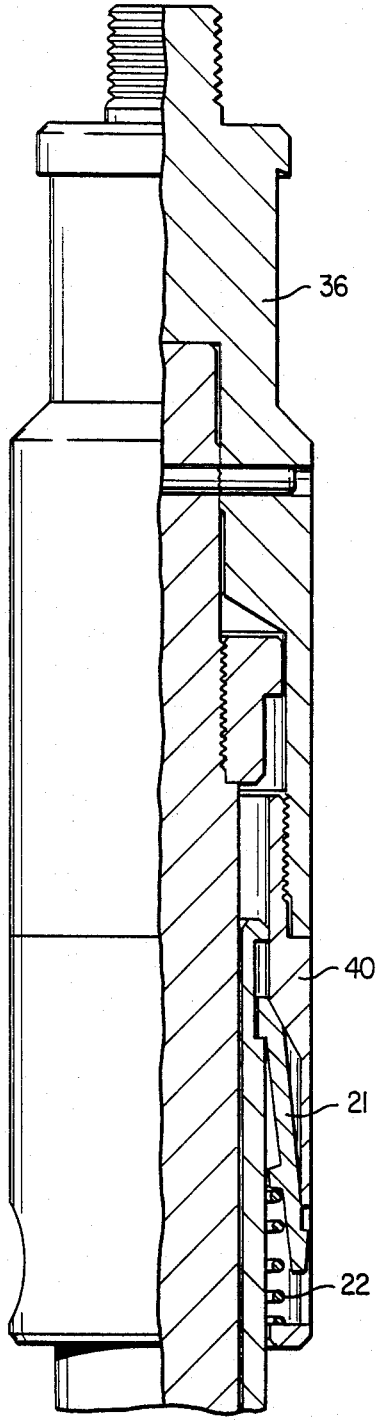
FIGS. 11A and 11B show the FIGS. 8A and 8B embodiment released from a fishing neck.
Figure 11B:
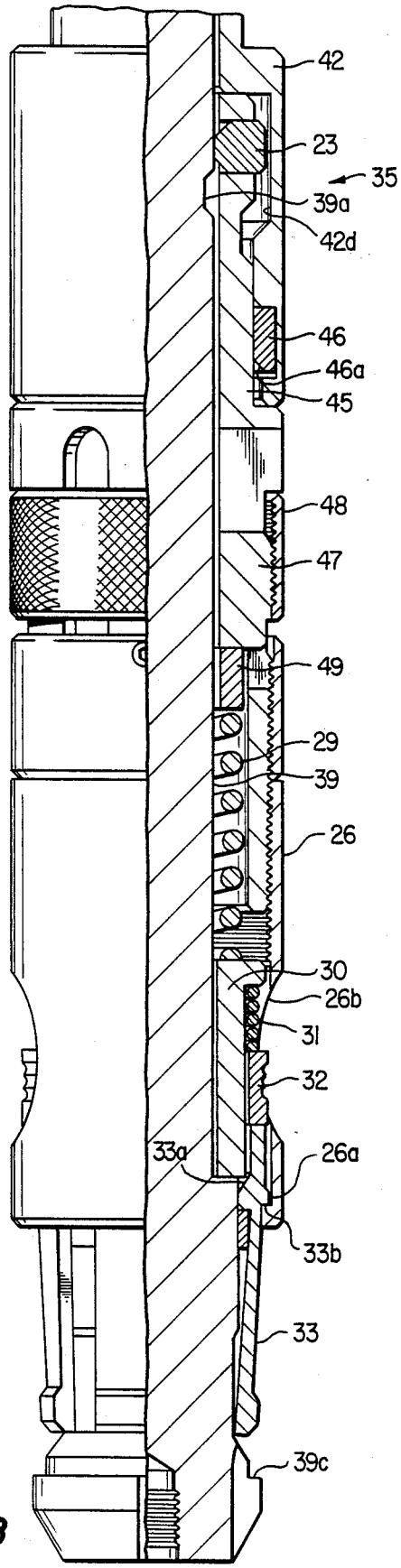

As the upper and intermediate housings are now connected by latches 21, downward jarring will move fishing neck 36, upper housing 40 and intermediate housing 42 downwardly, camming C ring 46 outwardly by surface 46a to slide down over the upper end of housing 45, moving overbore 42d over lugs 23 as shown in FIG. 11. Now compressed spring 29 moves housing 45 through ring 49, lugs 47 and ring 48 upwardly on the mandrel, camming lugs 23 out of mandrel groove 39a and into housing overbore 42d, disconnecting housing 45 from mandrel 39. Spring 29 moves housing 45 further upward, lifting skirt 26 and dogs 33 through shoulders 26a and 33b from shoulder 39c. Just before upward travel of the lower housing and dogs is stopped by contact with the lower end of intermediate housing 42, dog camming surface 33a contacts the outside lower end corner of spacer 30, and dogs 33 are cammed inwardly to contact a smaller diameter on mandrel 39, disengaging the well tool fishing neck and releasing tool 35 from the fishing neck for retrieval from the well.

To release tool 35 from an internal fishing neck of a retrieved well tool at the surface, retainer 32 may be gripped through skirt openings 26b and moved upwardly on spacer 30, compressing spring 31, lifting dogs 33 from shoulder 39c and camming the dogs to retract inwardly as shown in FIG. 11 releasing tool 35 from the fishing neck and well tool.

If pin 38 was sheared during well tool retrieving operations, upper housing 40 should be moved upwardly on housing 42 and latch projections 21c pushed in to disconnect the upper housing from the intermediate housing. Upper housing 40 may now be moved down around housing 42 to the position shown in FIG. 8, where a new shear pin 38 may be installed.

If the well tool could not be unlocked for retrieval to surface and tool 35 was jarred to release from the well tool, tool 35 will return to surface as shown in FIG. 11.

Figure 12:
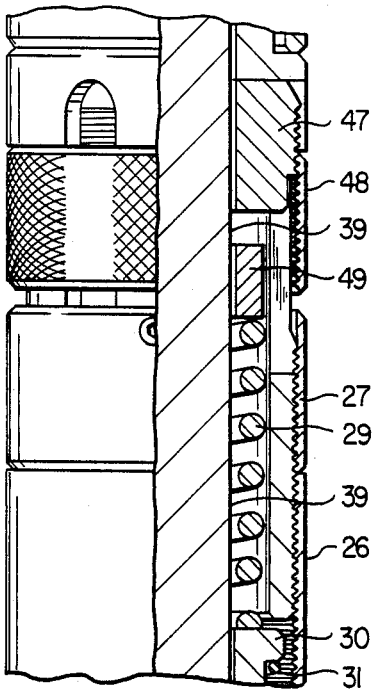
FIG. 12 is an elevational drawing in section of a portion of the running pulling tool of FIGS. 8A and 8B, showing all compression removed from the spring.

To return the tool 35 to the form shown by FIG. 8 for further use, ring 48 should be turned moving lugs 47 upwardly, permitting spring 29 and spring 31 to extend and move spacer 30 and ring 49 upwardly on mandrel 39 as shown by FIG. 12. Mandrel 39 is not now held in position by springs and may be moved freely upward by hand, reengaging the lower end of dogs 33 with mandrel shoulder 39*c* and realigning mandrel recess 39*a* adjacent lugs 23. Now moving intermediate locking housing 42 upwardly over mandrel 39 and release housing 45 reengages lugs 23 with mandrel recess 39*a* and ring 46 contracts into groove 45*b*. Next ring 48 should be turned to recompress springs 29 and 31 as shown in FIG. 8. After replacement of shear pin 38 as previously described, tool 35 is now ready for further use as a running or pulling tool.

I claim:

1. A tool for releasably engaging an internal fishing neck comprising:

(a) an elongate mandrel;

(b) means mounted on said mandrel for engaging and releasing the fishing neck including a housing slidably mounted around said mandrel, said housing having walls, openings through said walls and an external groove thereon below said openings;

(c) unlockable locking means for locking said engaging and releasing means in fishing neck engaging position on said mandrel including a recess on said mandrel, a lug mounted for lateral movement in each engagement and releasing housing opening, said lugs engageable in said mandrel recess, a locking housing slidably mounted around said engaging and releasing housing and said mandrel, said locking housing having an upper bore moveable over said lugs and a lower overbore therein, a C ring mounted in said overbore, said C ring engageable in said engaging and releasing housing groove;

(d) connecting means for connecting to said locking means to unlock and move said engaging and releasing means to a position on said mandrel releasing the tool from the fishing neck;

(e) means in said engaging and releasing means for manual repositioning of said mandrel in said locking means; and (f) means releasably connecting said connecting means to said mandrel.

2. The tool as defined in claim 1 wherein the engaging and releasing means further include upper and lower shoulders on the mandrel, an internal shoulder in the engaging and releasing housing and threads thereon, a skirt threadedly connected on said housing threads, said skirt having a lower internal shoulder, a spacer ring having an external shoulder slidably mounted around the mandrel in said skirt, inner biasing means in said engaging and releasing housing biasing said engaging and releasing housing upwardly, a dog retainer ring slidably mounted around said ring spacer below said spacer ring external shoulder, said spacer ring having openings therein, a dog mounted in each of said retainer ring openings and extending from said skirt, each said dog having upper external and internal shoulders and a lower lug engageable in an internal fishing neck, and outer biasing means in said skirt, biasing said dogs downwardly to contact said mandrel lower shoulder in fishing neck engaging position.

3. The tool as defined by claim 2 wherein the outer biasing means is a coil spring around the spacer ring between the spacer ring external shoulder and dog retainer ring.

4. The tool as defined by claim 2 wherein the engaging and releasing means further include releasable positioning means for moving the skirt internal shoulder into contact with the upper external dog shoulders and means locking said skirt in contacting position.

5. The tool of claim 4 wherein the skirt positioning and locking means comprise:

(a) a jam ring threadedly connected around the engaging and releasing housing above the skirt; and (b) a lock screw through said jam ring.

6. The tool as defined by claim 2 wherein the engaging and releasing means further include means for manually moving the dogs to fishing neck release position.

7. The tool as defined by claim 6 wherein the manual moving means comprise:

(a) openings in the skirt;

(b) gripping surfaces on the retainer ring, grippable through said openings in the skirt; and (c) a spring around the spacer ring between the spacer ring external shoulder and said retainer ring.

8. The tool as defined by claim 2 wherein the means in the engaging and releasing means for manual repositioning of the mandrel comprise;

(a) slots through the engaging and releasing housing;

(b) a lug in each slot having a thread thereon;

(c) a release ring threaded on the engaging and releasing housing threads above the skirt, said release ring having an internal thread engaging said lugs and said housing threads; and (d) a bearing ring slidably mounted around the mandrel.

9. The tool as defined by claim 8 wherein the inner biasing means is a coil spring around the mandrel between the spacer ring and the bearing ring.

10. The tool as defined by claim 1 wherein the connecting means comprise:

(a) a groove around the locking housing;

(b) a connecting housing slidably mounted on the mandrel and locking housing, said connecting housing having an upper end connection, an external fishing neck therebelow, a through bore, an overbore in said through bore, an upwardly and inwardly tapering camming surface connecting said through bore and said overbore, and lateral openings through said connecting housing in said overbore;

(c) latches slidably mounted on the locking housing in said connecting housing overbore, each latch having an upper lug engageable in said locking housing groove, a camming surface, and a lower lug protrudable into each of said connecting housing openings; and (d) biasing means biasing said latch camming surfaces into engagement with said connecting housing camming surface.

11. The tool as defined in claim 10 wherein the means releasably connecting the connecting means to the mandrel is a shear pin through the connecting housing and mandrel.

12. The tool of as defined by claim 10 wherein the biasing means comprise:

(a) an internal shoulder in each latch; and (b) a spring around the locking housing between said shoulders and a shoulder on said locking housing.

13. A tool for releasably engaging an internal fishing neck comprising:

(a) an elongate mandrel having upper and lower shoulders;

(b) means mounted on said mandrel for engaging and releasing the fishing neck including a releasing and engaging housing having an internal shoulder and an upper external groove thereon, said housing slidably mounted on said mandrel above said upper mandrel shoulder, a skirt having an internal shoulder threadedly connected on said housing, a spacer ring having an external shoulder slidably mounted around said mandrel above said upper mandrel shoulder in said skirt, inner biasing meand in said housing biasing said housing upwardly, a retainer ring slidably mounted around said spacer ring and said mandrel below said spacer ring external shoulder, said spacer ring having openings therein, a dog mounted in each of said ring openings and extending from said skirt, each said dog having an upper external and inner shoulders and a lower lug engageable in an internal fishing neck, and outer biasing means in said skirt biasing said dogs downwardly to contact said mandrel lower shoulder in fishing neck engaging position;

(c) unlockable locking means for locking said engaging and releasing means in fishing neck engaging position on said mandrel including a recess on the mandrel above said upper mandrel shoulder, openings in said engaging and releasing housing, a laterally moveable lug in each said engaging and releasing housing opening, said lugs engageable in said mandrel recess, a locking housing slidably mounted around said mandrel, said locking housing having an internal recess, a bore and an overbore in said bore and a C ring in said overbore engageable in said releasing and engaging housing external groove;

(d) connecting means for connecting to said locking means to unlock and move said engaging and releasing means to a position on said mandrel releasing said tool from the fishing neck including a connecting housing slidably mounted on said mandrel and locking housing, said connecting housing having an upper end connection, an external fishing neck, a through bore, and an overbore in said through bore, an upwardly and inwardly tapering camming surface between said through bore and said overbore, and lateral openings through said connecting housing in said overbore, latches slidably mounted on said locking housing in said connecting housing overbore, each latch having an upper lug engageable in said locking housing recess, a tapered camming surface, and a lower lug protrudable into a lateral opening;

(e) means in said engaging and releasing means for manual repositioning of said mandrel in said locking means including slots through the engaging and releasing means housing, a lug in each slot, a release ring threadedly connected on the engaging and releasing housing above said skirt on said lugs, and a bearing ring slidably mounted around the mandrel; and (f) a shear pin through said connecting means housing and said mandrel releasably connecting said connecting means housing to said mandrel.

* * * * *